United States Patent [19]

Mazzoli

[11] Patent Number: 4,965,902

[45] Date of Patent: Oct. 30, 1990

[54] SOCK JOINING METHOD

[76] Inventor: Rodney E. Mazzoli, 7210 E. Cypress Head Dr., Parkland, Fla. 33067

[21] Appl. No.: 377,693

[22] Filed: Jul. 10, 1989

Related U.S. Application Data

[63] Continuation-in-part of Ser. No. 148,744, Jan. 14, 1988, abandoned.

[51] Int. Cl.[5] ..... D06F 35/00

[52] U.S. Cl. ..... 8/150; 8/159

[58] Field of Search ..... 8/150, 150.5, 154, 159

[56] References Cited

U.S. PATENT DOCUMENTS

| | | | |
|---|---|---|---|
| 2,094,501 | 9/1937 | Schmitz, Jr. | 8/159 |
| 3,000,384 | 9/1961 | Piers, Jr. . | |
| 3,634,947 | 1/1972 | Furgal . | |
| 3,688,348 | 9/1972 | Klotz et al. . | |
| 3,895,128 | 7/1975 | Gaiser . | |
| 3,972,131 | 8/1976 | Rudy et al. . | |
| 4,058,853 | 11/1977 | Boxer et al. . | |
| 4,214,331 | 7/1980 | Freeze | 8/150 |
| 4,254,139 | 3/1981 | Hendrickson et al. . | |
| 4,388,739 | 6/1983 | Martion et al. | 8/150 |
| 4,473,373 | 9/1984 | Weiss | 8/150 |
| 4,494,264 | 1/1985 | Wattiez et al. | 8/150 |

*Primary Examiner*—Frankie L. Stinson

*Attorney, Agent, or Firm*—Townsend and Townsend

[57] ABSTRACT

Pairs of socks are joined in preparation for laundering by removing a length of material from a supply of the material, wrapping the length of material around a pair of socks and securing the wrapped length of material to the pair of socks, such as by tying or using an adhesive on the material. The length of material can be impregnated with a fabric conditioner, such as a fabric softener, an anti-cling agent and so forth. To easily separate or segregate pairs of socks into groups according to their identities, such as owner or type of sock, a visually different length of material for each group is used. The visual differences may be a matter of color, markings or indicia, such as numbers or letters.

9 Claims, 1 Drawing Sheet

SOCK JOINING METHOD

This application is a continuation-in-part of application Ser. No. 148,744, filed Jan. 14, 1988, now abandoned.

BACKGROUND OF THE INVENTION

This invention relates to a method for laundering pairs of socks, in particular a method for keeping pairs of socks together and allowing the laundered pairs of socks to be easily visually segregated by group or type after laundering.

Matching up socks after doing a load of wash is a rather tedious job. Various solutions have been proposed in response to this problem. For example. U.S. Pat. No. 4,058,853 to Boxer et al. shows socks releasably secured to one another using hook and loop fasteners secured to the tops of each of the socks. Another method is shown in U.S. Pat. No. 3,688,348 to Klotz et al. by which a band, having hook and loop fasteners, is used to secure the socks to one another.

One of the problems with these prior art methods is that although the socks have been joined, they still must be separated as to identity. That is, often a load of wash has socks from a number of different individuals so it still must be determined which socks belong to which person. This can often be a difficult task.

SUMMARY OF THE INVENTION

The present invention is directed to a method by which pairs of socks are joined in preparation for laundering the socks so that socks not only remain together while laundering but are identified in a manner to permit them to be easily segregated into groups after laundering.

Pairs of socks are joined in preparation for laundering by removing a length of wrapping material from a supply of the material, wrapping the length of material around the pair of socks and then securing the wrapped length of material to the pair of socks, such as by tying or using an adhesive on the material. The length of material can be impregnated with a fabric conditioner, such as fabric softener, an anti-cling agent and so forth. The invention also enables the user to easily separate or segregate pairs of socks into groups according to their identities, such as owner or type of sock. To do so a visually different lengths of wrapping material are used for each group, typically for each individual. The visual distinction between the lengths of materials for the different groups may be by color, ornamental design or other indicia such as numbers, letters, etcetera. After the socks are washed, the visually distinctive lengths of material permit the pairs of socks to be easily grouped.

The invention preferably uses lengths of material which are disposable. However, the invention can be practiced with reusable lengths of wrapping material if desired.

One of the primary advantages of the invention is that several functions are achieved by the method of the invention. Socks are paired prior to laundering in a manner so that after laundering the pairs of socks can be grouped by identity easily and quickly. The invention further provides for the disbursal of conditioning agents, such as fabric softener, anti-cling agents, stain removers, perfumes and so forth by impregnating one or more of these fabric conditions into the length of material.

Other features and advantages of the invention will appear from the following description in which the preferred embodiment has been set forth in detail in conjunction with the accompanying drawing.

DETAILED DESCRIPTION OF THE PREFERRED EMBODIMENT

Figure 1:
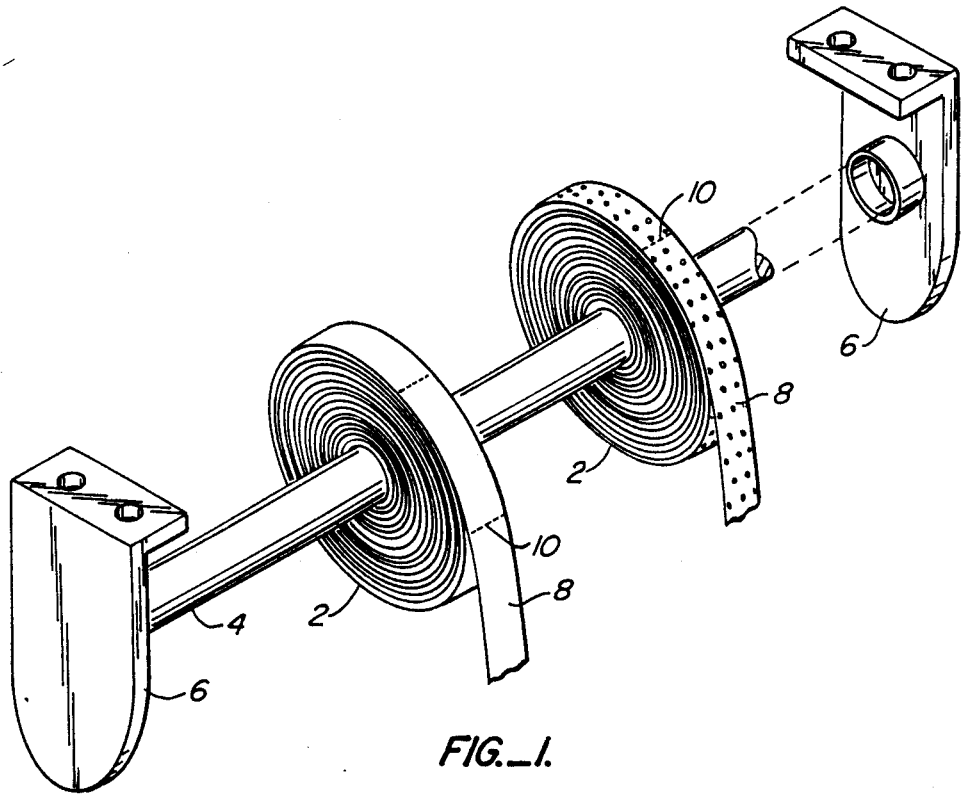
FIG. 1 shows a pair of rolls of wrapping material mounted to a common dispensing shaft.
Figure 2:
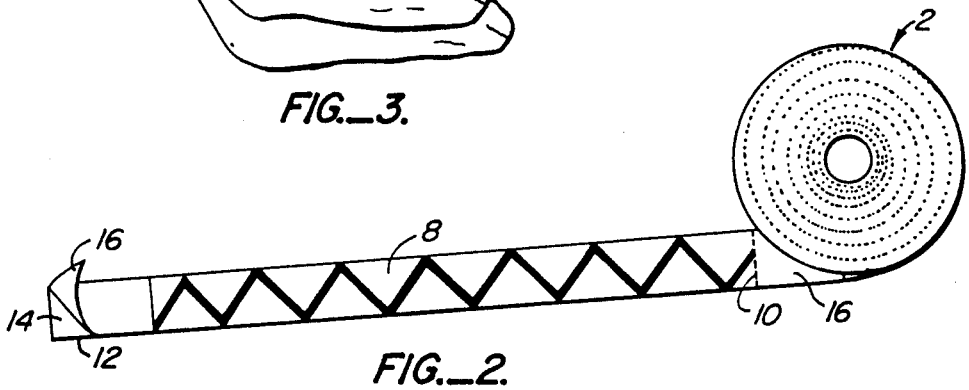
FIG. 2 is a side view of a roll of FIG. 1 with a length of material unrolled from the roll showing the perforation lines separating the lengths of material and an adhesive at one end of the length of material.

Referring now to FIG. 1, first and second rolls of wrapping material 2 are shown mounted to a support shaft 4, the support shaft being supported at its ends by a pair of brackets 6. Rolls 2, as shown in FIG. 2, are made up of lengths of material 8 secured to one another at perforations 10. Each length of material 8 includes an adhesive end 12 having an adhesive 14 applied thereto. Adhesive 14 is preferably covered by a removable protective film 16 so to expose adhesive 14 only when desired.

Figure 3:
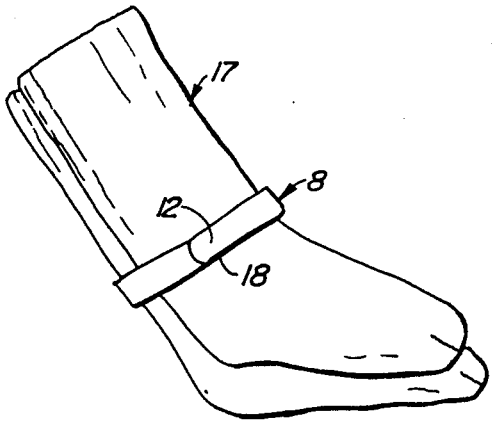
FIG. 3 shows a pair of socks fastened together using a length of material of FIG. 2.

Length of material 8 is separated from the remainder of roll 2 by separation at perforations 10. Length of material 8 is then wrapped around a pair of socks 17 as shown in FIG. 3, film 16 is removed and adhesive end 12 is secured to appropriate position 18 along length of material 8 so to keep pairs of socks 17 together while being laundered.

Length of material 8 is preferably impregnated with a fabric conditioner, such as a fabric softener, an anti-cling agent, a stain remover or a perfume. One example of such a material is that made by Proctor and Gamble of Cincinnati, Ohio under the trademark BOUNCE. See also U.S. Pat. No. 4,254,139 to Hendrickson et al. which shows an article which is used to dispense conditioner in a washer or dryer.

An important aspect of the invention relates to using rolls of wrapping material 2 which are visually distinguishable. For example, the two rolls 2 shown in FIG. 1 are visually distinguishable, one being plain while the other having a speckled appearance. Roll 2 of FIG. 2 has a still further type of visually distinguishing pattern. In this manner each pair of socks 17 which has a certain identity, typically socks belonging to a particular person can be secured together with lengths of material 8 having the same visually distinguishable markings. For example, in home use, each person could bind together his or her pairs of socks 17 using a particular roll of wrapping material 2 visually unique for that individual in so far as color, design, etcetera is concerned. Thus, lengths of material 8 not only keep pairs of socks 17 together while being laundered, lengths of material 8 also help the user separate pairs of socks 17 into appropriate groups, typically according to the owner of the socks.

Modification and variation can be made to the disclosed embodiment without departing from the subject of the invention as defined in the following claims. For example, although the invention has been described with reference to a fabric such as that used with BOUNCE brand fabric sheets, other types of materials can be used as well. Although lengths of material 8 are preferably of a fabric material which can be impregnated with various fabric conditioners, lengths of material 8 may also be made of material which is not suitable for impregnation.

What is claimed is:

1. A method for joining a pair of socks in preparation for laundering the pair of socks in a load of wash, the pair of socks belonging to a first group, comprising the following steps:

selecting a first supply of lengths of material from a plurality of visually distinguishable supplies of lengths of material according to the identity of the group of the pair of socks;

removing a length of material, having first and second ends, from the first supply of lengths of material;

wrapping the length of material around the pair of socks; and securing the wrapped length of material in position around the pair of socks so to keep the pair of socks together in the load of wash and permit the pair of socks to be readily identifiable as belonging to the first group.

2. The method of claim 1 wherein the removing step is carried out by removing a length of material, impregnated with a fabric conditioner, from the first supply of lengths of material.

3. The method of claim 1 wherein the securing step is carried out by securing the first end of the length of material to a position along the length of material through an adhesive on the first end.

4. The method of claim 1 wherein the removing step is carried out by removing the length of material from a roll of the material.

5. A method for laundering pairs of socks, the pairs of socks having a first number of group identities which distinguish pairs of socks in one group from pairs of socks in the other groups, comprising the following steps:

removing lengths of material from the first number of supplies of lengths of material, the first number of supplies of the lengths of material being visually distinguishable from one another:

securing the visually distinguishable lengths of material with the pairs of socks according to the group identities of the pairs of socks so that the pairs of socks having a particular group identity are secured with like lengths of material;

washing and drying the secured pairs of socks; and removing the lengths of material from the pairs of socks.

6. The method of claim 5 wherein the first removing step is carried out using lengths of material which are impregnated with a fabric conditioner, the lengths of material having first and second ends.

7. The method of claim 6 further comprising the step of disposing of the lengths of material after the second removing step.

8. The method of claim 5 wherein the first removing step is carried out using lengths of material having adhesive surfaces at the first ends.

9. The method of claim 5 further comprising the step of segregating the pairs of socks by group after the washing and drying step.

* * * * *